United States Patent [19]

Augustin

[11] 4,427,347

[45] Jan. 24, 1984

[54] FUEL INJECTION PUMP FOR INTERNAL COMBUSTION ENGINES

[75] Inventor: Ulrich Augustin, Kernen, Fed. Rep. of Germany

[73] Assignee: Daimler-Benz A.G., Fed. Rep. of Germany

[21] Appl. No.: 214,416

[22] Filed: Dec. 8, 1980

[30] Foreign Application Priority Data

Dec. 6, 1979 [DE] Fed. Rep. of Germany ..... 2949014

[51] Int. Cl.[3] ..... F04B 49/00

[52] U.S. Cl. ..... 417/296; 417/501; 417/569

[58] Field of Search ..... 417/501, 296, 569, 560, 417/559; 137/493.9, 512.15, 512.4

[56] References Cited

U.S. PATENT DOCUMENTS

| | | | |
|---|---|---|---|
| 2,214,364 | 9/1940 | Edwards | 417/559 |
| 2,421,475 | 6/1947 | Beeh | 417/493 X |
| 2,713,310 | 7/1955 | Muraszew | 417/501 |
| 3,791,407 | 2/1974 | Nicholls | 137/512.15 |

*Primary Examiner*—Edward K. Look

*Attorney, Agent, or Firm*—Craig & Burns

[57] ABSTRACT

A fuel injection pump for internal combustion engines with the injection pump including a dual-acting check valve arranged between the pump cylinder and a valve holder of the injection pump. The check valve is constituted by a resilient valve disk which includes a central passage. A base plate, provided with inlet bores and a central throttle acting in a direction opposite a fuel conveying direction of the injection pump, is arranged between the pump cylinder and the valve holder. The base plate forms an abutment for the valve disk when the check valve opens in a direction opposite the fuel conveying direction of the injection pump.

10 Claims, 1 Drawing Figure

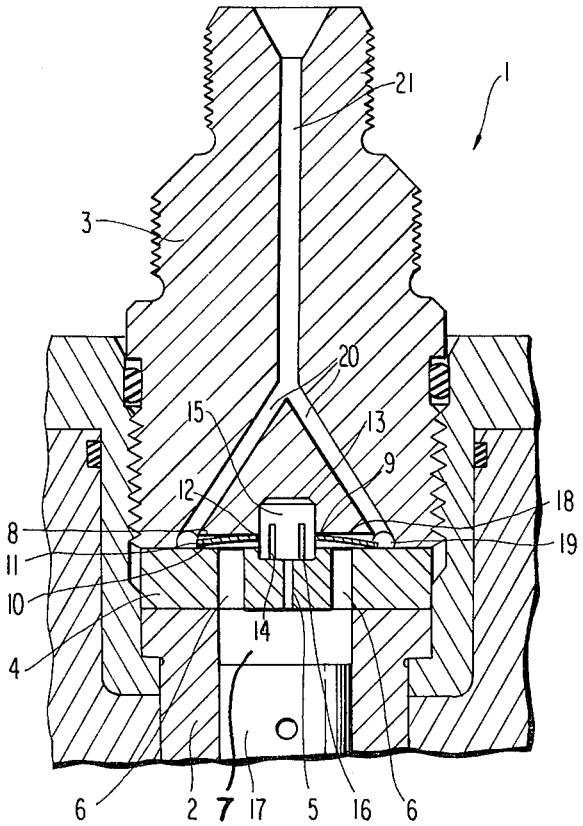
1
21
3
20
15
13
9
12
18
8
19
11
10
14
4
6
2
7
17
5
16
6

FUEL INJECTION PUMP FOR INTERNAL COMBUSTION ENGINES

The present invention relates to an injection pump and, more particularly, to a fuel injection pump for internal combustion engines, with the injection pump including a double-acting check valve arranged between a pump cylinder and a valve holder of the injection pump, which check valve is formed by a resilient valve disk having a central passage and resting directly, in a zone of an outer circumference thereof, against the pump cylinder and simultaneously, in a zone of the central passage, against the valve holder, with the valve disk being adapted to open in the conveying direction, at the outer circumference and, subsequently, in the opposite direction, in the zone of the central passage.

In a fuel injection pump arrangement of the aforementioned type, pressure waves occur after an injection step in a conduit system between the check valve connected downstream of the injection pump and the injection nozzle. A disadvantage of the occurrence of the pressure waves resides in the fact that the pressure waves are frequently repeatedly reflected back and forth between the injection pump and the injection nozzle and often reach a pressure level which causes an injection nozzle to open again and to emit an additional jet or spray of fuel.

To avoid the above-noted disadvantage, a dual-acting check valve is proposed in U.S. Pat. No. 2,214,364, wherein the check valve opens in a direction opposite to the conveying direction of the fuel, that is, in a direction toward the pump piston of the injection pump so that, upon the occurrence of an excessive pressure in a pressure line leading to the injection nozzle, fuel may be discharged from the pressure line in a direction toward the pump working chamber. However, the returning pressure waves in this proposed construction are of such a size that the valve disk is urged into an opening of the pump working chamber and, consequently, the valve disk is deformed which, as can readily be appreciated, may result in the destruction of the valve disk after a certain operating period.

The aim underlying the present invention essentially resides in providing a fuel injection pump for an internal combustion engine which ensures, by special measures in the fuel injection pump, a stable pressure in the pressure conduit system, in addition to ensuring a permanent and trouble-free operability of a double or dual-acting check valve.

In accordance with advantageous features of the present invention, a base plate with inlet bores and with a central throttle opening acting in the opposite direction are provided between the pump cylinder and the valve holder, with the base plate constituting an abutment for the valve disk opening in the opposite direction.

By virtue of the above-noted features of the present invention, during a relief, that is, after an injection, the valve disk, in the deflected condition, need not absorb any forces since it is entirely in contact with the base plate.

While a pressure valve is proposed in German Pat. No. 807,869, wherein a base plate and valve member are provided, in this proposed construction the valve member acts as a reflux throttle without any additional valve characteristics; however, the reflux throttle is not capable, by itself, of ensuring a specific pressure or a specific filling of the injection conduit.

In accordance with further advantageous features of the present invention, a slotted or notched hollow centering pin is provided in the central passage of the valve disk between recesses of a valve holder and the base plate, with a throttle terminating in the hollow space of the centering pin.

By virtue of the provision of the centering pin in accordance with the present invention, it is possible to provide the valve disk with a specific defined position.

Accordingly, it is an object of the present invention to provide a fuel injection pump for an internal combustion engine which avoids, by simple means, shortcomings and disadvantages encountered in the prior art.

A further object of the present invention resides in providing a fuel injection pump for internal combustion engines which minimizes if not avoids occurrence of an inadvertent additional discharge of fuel following an injection by the injection pump.

Yet another object of the present invention resides in providing a fuel injection pump for internal combustion engines which ensures the existence of a stable pressure in the conduit system associated with the fuel injection pump.

Yet another object of the present invention resides in providing a fuel injection pump for internal combustion engines which minimizes the forces acting upon a valve member of the fuel injection pump.

A still further object of the present invention resides in providing a fuel injection pump for internal combustion engines which is simple in construction and therefore relatively inexpensive to manufacture.

Another object of the present invention resides in providing a fuel injection pump for internal combustion engines which functions reliably under all operating conditions of the engine.

These and other objects, features, and advantages of the present invention will become more apparent from the following description when taken in connection with the accompanying drawing which shows, for the purposes of illustration only, one embodiment in accordance with the present invention, and wherein:

The single FIGURE is an axial cross-sectional view of a fuel injection pump for internal combustion engines in accordance with the present invention.

Referring now to the single FIGURE of the drawing, according to this figure, a pump element generally designated by the reference numeral 1 of a fuel injection pump for internal combustion engines includes a base plate 4 clamped between a pump cylinder 2 and a valve holder 3. A central throttle 5 at inlet bores 6 is arranged in the base plate 4, with the inlet bores 6 and throttle 5 being in communication with a pump working chamber 7.

A dual-acting check valve is arranged in a valve holder recess 8 between the base plate 4 and the valve holder 3. The check valve includes a resilient valve disk 10 having a passage 9. The base plate 4 and valve holder 3 form mutually opposed valve seats for the valve disk 10. In a rest condition, the valve disk forms a seal with its outer rim 11 against a planar surface of the base plate 4 and with the inner rim 12 against the valve holder 3.

A further recess 13 is provided in the valve holder 3, with a hollow centering pin 15, provided with slots 14, being fitted or accommodated in the recess 13. The pin 15 serves to center the valve disk 10 and is located in a recess 16 arranged in the base plate 4. The throttle 5 terminates in the recess 16 in the base plate 4.

During an upward stroke of the pump piston 17, a conveyance of the fuel begins and, during this step, beginning with a certain pressure, the outer rim 11 of the valve disk 10 lifts off from the surface of the planar base plate 4 forming the valve seat and contacts a bottom surface 18 of the recess 8 so that fuel flows through the inlet bores 6, through the recess 8, by way of an annular recess 19, through channels 20 branching off from the recess 19, and finally through a centrally arranged channel 21 into a pressure line (not shown) leading to a fuel injection nozzle (not shown).

During a relief step in the pressure conduit system, that is, after a fuel injection has taken place, the valve disk 10 is pressed downwardly in a zone of the centering pin 15 and contacts the planar base plate 4 serving as the abutment or valve seat. The inlet bores 6 are closed and fuel flows through the slotted centering pin 15 and the throttle 5 back into the pump working chamber 7 until a relief pressure has been reached by means of which the valve disk 10 is returned into the illustrated starting position.

While I have shown and described only one embodiment in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A fuel injection pump for an internal combustion engine, the fuel injection pump including a pump cylinder, a valve holder, means provided in the valve holder for communicating the valve holder with a fuel injection line, and a dual-acting check valve means arranged between the pump cylinder and the valve holder, the dual-acting check valve means including a resilient valve disk means having a central passage therein for deforming to convey fuel to the fuel injection line and for conforming to the surface of the base plate from the edge of the valve disk means contiguous to the central passage to the outer dimension of the valve disk means when the valve disk means is open in a direction opposite to the fuel conveying direction, characterized in that a base plate is interposed between the pump cylinder and the resilient valve disk means, the base plate includes inlet bore means for communicating the pump cylinder with the communicating means in the valve holder, and a throttle means arranged between the pump cylinder and the valve holder and acting in a direction opposite to a fuel conveying direction of the injection pump, and in that the base plate forms an abutment for the valve disk means of the check valve means when the check valve means opens in a direction opposite the fuel conveying direction.

2. A fuel injection pump according to claim 1, characterized in that the valve disk of the check valve means is arranged such that, in a rest condition, the valve disk rests directly against the valve holder in an area of the central passage of the disk member and simultaneously against the base plate in an area of an outer circumference of the disk member, and in that, upon an opening of the check valve means in a fuel conveying direction, the outer circumference of the valve disk lifts off from the base plate so as to enable fuel to flow through the inlet bore means.

3. A fuel injection pump for an internal combustion engine, the fuel injection pump including a pump cylinder, a valve holder, means provided in the valve holder for communicating the valve holder with a fuel injection line, and a dual-acting check valve means arranged between the pump cylinder and the valve holder, the dual-acting check valve means including a resilient valve disk having a central passage therein, a base plate is interposed between the pump cylinder and the resilient valve disk, the base plate includes inlet bore means for communicating the pump cylinder with the communicating means in the valve holder, and a throttle means arranged between the pump cylinder and the valve holder and acting in a direction opposite to a fuel conveying direction of the injection pump, the base plate forms an abutment for the valve disk of the check valve means when the check valve means opens in a direction opposite the fuel conveying direction, characterized in that a hollow pin means is disposed in the central passage of the valve disk for centering the valve disk, recess means are provided in both the valve holder and the base plate for accommodating the hollow pin means, the throttle means terminates in a hollow space of the pin means, and in that means are provided in the pin means for communicating the communicating means in the valve holder with the hollow space in the pin means.

4. A fuel injection pump according to claim 3, characterized in that the communicating means in the pin means includes a plurality of slots.

5. A fuel injection pump according to claim 3, characterized in that the communicating means in the pin means includes a plurality of notches.

6. A fuel injection pump according to claim 3, characterized in that the communicating means in the valve holder includes a further recess means for accommodating the valve disk, the further recess means is in communication with the inlet bores, and in that the valve disk is adapted to be brought into contact with an upper surface of the further recess means when the check valve means is opened in the fuel conveying direction.

7. A fuel injection pump according to claim 6, characterized in that the communicating means in the valve holder further includes an annular recess disposed about the further recess means and in communication therewith, channel means branching off from said annular recess, and a centrally disposed channel communicating with the channel means and the fuel injection line.

8. A fuel injection pump according to claim 7, characterized in that the communicating means in the pin means includes a plurality of slots.

9. A fuel injection pump for an internal combustion engine, the fuel injection pump including a pump cylinder, a valve holder, means provided in the valve holder for communicating the valve holder with a fuel injection line, and a dual-acting check valve means arranged between the pump cylinder and the valve holder, comprising a base plate adjacent the pump cylinder comprising inlet bore means for communicating the pump cylinder with the communicating means in the valve holder, throttle means arranged between the pump cylinder and the valve holder for throttling in a direction opposite to a fuel conveying direction of the injection pump, and a resilient valve disk means, with a central passage therein, for deforming to convey fuel to the fuel injection line and for conforming to the surface of the base plate from the edge of the valve disk means contiguous to the central passage to the outer dimension of the valve disk means when the valve disk means is open in a direction opposite to the fuel conveying direction.

10. A fuel injection pump for an internal combustion engine, the fuel injection pump including a pump cylinder, a valve holder, means provided in the valve holder for communicating the valve holder with a fuel injection line, and a dual-acting check valve means arranged between the pump cylinder and the valve holder, the dual-acting check valve means including a resilient valve disk having a central passage therein, a base plate is interposed between the pump cylinder and the resilient valve disk, the base plate includes inlet bore means for the valve holder, and a throttle means arranged between the pump cylinder and the valve holder and acting in a direction opposite to a fuel conveying direction of the injection pump, the base plate forms an abutment for the valve disk of the check valve means when the check valve means opens in a direction opposite the fuel conveying direction, the valve disk of the check valve means is arranged such that, in a rest condition, the valve disk rests directly against the valve holder in an area of the central passage of the disk member and simultaneously against the base plate in an area of an outer circumference of the disk member, upon an opening of the check valve means in a fuel conveying direction, the outer circumference of the valve disk lifts off from the base plate so as to enable fuel to flow through the inlet bore means, characterized in that a hollow pin means is disposed in the central passage of the valve disk for centering the valve disk, recess means are provided in both the valve holder and the base plate for accommodating the hollow pin means, the throttle means terminates in a hollow space of the pin means, and in that means are provided in the pin means for communicating the communicating means in the valve holder with the hollow space in the pin means.

* * * * *